US010539278B2

(12) United States Patent
Ngai

(10) Patent No.: US 10,539,278 B2
(45) Date of Patent: Jan. 21, 2020

(54) LUMINAIRE FOR CREATING EFFECTIVE PROXIMITY LIGHTING IN A LOW AMBIENT LIGHTING ENVIRONMENT

(71) Applicant: ABL IP Holding, LLC, Conyers, GA (US)

(72) Inventor: Peter Y. Y. Ngai, Alamo, CA (US)

(73) Assignee: ABL IP Holding, LLC, Conyers, GA (US)

( * ) Notice: Subject to any disclaimer, the term of this patent is extended or adjusted under 35 U.S.C. 154(b) by 305 days.

(21) Appl. No.: 14/838,244

(22) Filed: Aug. 27, 2015

(65) Prior Publication Data

US 2016/0061393 A1 Mar. 3, 2016

Related U.S. Application Data

(60) Provisional application No. 62/044,296, filed on Aug. 31, 2014.

(51) Int. Cl.

| | |
|---|---|
| ***F21S 6/00*** | (2006.01) |
| *F21V 21/06* | (2006.01) |
| *F21Y 105/00* | (2016.01) |
| *F21Y 115/15* | (2016.01) |
| *F21Y 115/10* | (2016.01) |

(52) U.S. Cl.

CPC ..... *F21S 6/003* (2013.01); *F21V 21/06* (2013.01); *F21Y 2105/00* (2013.01); *F21Y 2115/10* (2016.08); *F21Y 2115/15* (2016.08)

(58) Field of Classification Search

CPC ..... F21S 6/003; F21S 6/008

See application file for complete search history.

(56) References Cited

U.S. PATENT DOCUMENTS

| | | | | |
|---|---|---|---|---|
| 4,991,065 | A * | 2/1991 | Engel | F21S 2/00 362/278 |
| 5,034,863 | A * | 7/1991 | Huang | F21V 23/06 362/414 |
| 5,065,297 | A * | 11/1991 | Santambrogio | F21V 21/22 362/287 |
| 5,459,376 | A | 10/1995 | Buij et al. | |
| D703,864 | S | 4/2014 | Blum et al. | |

(Continued)

OTHER PUBLICATIONS

Gustac Fechner, Elements of Psychophysics, 1966*, Holt, Rinehart and Winston, Inc , p. 122 *English translation of "Elemente der Psychophysik" published 1860 (Year: 1966).*

(Continued)

*Primary Examiner* — Jong-Suk (James) Lee
*Assistant Examiner* — Christopher E Dunay
(74) *Attorney, Agent, or Firm* — Beeson Skinner Beverly, LLP

(57) ABSTRACT

A luminaire is provided for illuminating a task surface and a volume of space above and about the task surface, including a limited human occupiable space proximate the task surface. The luminaire includes a body having a base end and an extension portion extending from the base end. A task lighting element on the body, and suitably at the base of the body, directs light in a directional light distribution pattern toward a task surface. Area light sources on the extension portion of the body emit light in a diffuse light distribution pattern for illuminating the volume of space over the task surface and a limited human occupiable space proximate the task surface.

17 Claims, 5 Drawing Sheets

(56) References Cited

U.S. PATENT DOCUMENTS

| | | | | |
|---|---|---|---|---|
| D740,473 | S * | 10/2015 | Chen | D26/35 |
| 9,194,555 | B2 | 11/2015 | Urban | |
| 9,353,921 | B2 | 5/2016 | Bembridge et al. | |
| 9,416,922 | B1 * | 8/2016 | Stagni | H05B 33/0845 |
| 2008/0094827 | A1 * | 4/2008 | Huffman | F21S 6/003 362/197 |
| 2009/0262545 | A1 * | 10/2009 | Amelung | B60Q 1/34 362/487 |
| 2009/0296381 | A1 * | 12/2009 | Dubord | F21S 2/005 362/218 |
| 2010/0046210 | A1 * | 2/2010 | Mathai | H01L 51/52 362/147 |
| 2010/0165644 | A1 * | 7/2010 | Zheng | F21S 6/003 362/373 |
| 2012/0091903 | A1 * | 4/2012 | Bembridge | F21S 6/005 315/178 |
| 2012/0098437 | A1 | 4/2012 | Smed | |
| 2013/0240933 | A1 * | 9/2013 | Yamazaki | H01L 33/504 257/98 |
| 2014/0133172 | A1 * | 5/2014 | Vissenberg | F21V 14/00 362/555 |
| 2014/0286008 | A1 * | 9/2014 | Hack | F21K 9/90 362/249.01 |
| 2015/0360271 | A1 * | 12/2015 | Hawkins | G01N 21/8803 362/219 |
| 2016/0153628 | A1 * | 6/2016 | Copeland | F21S 6/003 362/282 |
| 2016/0169462 | A1 * | 6/2016 | Hawkins | G01N 21/8806 362/219 |

OTHER PUBLICATIONS

Ngai, Peter Y. "Evaluations of Low Ambient Task—Surround Lighting System in a Simulated Environment." Journal of Solid State Lighting J Sol State Light 3.1 (Apr. 26, 2016).

Ngai, Peter Y. "56.1 Invited Paper: Creating an Effective Lighting Environment with Task—Surround—Ambient Lighting." SID Symposium Digest of Technical Papers 46.1. pp. 835-838. (Jun. 5, 2015).

* cited by examiner

LUMINAIRE FOR CREATING EFFECTIVE PROXIMITY LIGHTING IN A LOW AMBIENT LIGHTING ENVIRONMENT

CROSS-REFERENCE TO RELATED APPLICATIONS

This application claims the benefit of U.S. Provisional Patent Application No. 62/044,296 filed Aug. 31, 2015.

BACKGROUND OF INVENTION

The present invention generally relates to luminaires for illuminating a space, and more particularly to luminaires for lighting a confined space.

With ever increasing energy costs and the push to reduce energy consumption, building owners are under pressure to reduce the amount of energy devoted to lighting. Reduction in energy consumption for lighting can be achieved by replacing inefficient light sources with light sources that consume less energy for a given light output. Reduction in energy consumption is also often achieved by simply turning down the lights to thereby reduce the amount of ambient lighting in the room, and supplementing light on work surfaces, such as table tops and desk tops, in work spaces with task lighting, such as desk lamps or under-counter lights. Because task lights do not need to generate the amount of light needed to illuminate an entire room, they consume far less energy. From an energy efficiency point of view, only task lights would be used in a space, without ambient lighting. However, from a practical point of view some ambient lighting is required for circulation and to provide visibility to surrounding architectural structures and amenities in the space. For example, if the ambient lighting in a task lit space were reduced from 30 footcandles to 10 footcandles, the energy savings would be substantial.

The problem with relying on task lighting in a space with a low level of ambient lighting is that the areas immediately surrounding the task surfaces will not be well lit. The task lighting will permit a person working at the task to see his or her task without difficulty, but colleagues stand or sitting in proximity to that person will be in low light and shadows, making personal interactions more difficult and the overall work environment less inviting.

The present invention overcomes the problem of providing well-lighted working spaces in a low ambient lighting environment. The invention provides a luminaire and method for illuminating a task surface as well as illuminating a localized volume of space above and about the task surface (sometimes referred to herein as "surround volume") without a significant contribution from low ambient lighting. The luminaire and method of the invention provide vertical illumination at and in proximity to the task surface sufficient to illuminate features, such as facial features, within the surround volume and does so in a manner that avoids harsh highlights and/or shadows on such features. In its illustrated embodiment, the invention also addresses the problem of providing volumetric illumination in a manner that does not create visual discomfort caused by light sources exhibiting excessive brightness.

SUMMARY OF INVENTION

The invention is directed to a luminaire having a task light component and proximity lighting component. The task light component provides task lighting on a task surface in front of the luminaire, while the proximity lighting component spreads light into a volume of space above and about the task surface, effectively creating a localized bubble of light about the task area. A luminaire in accordance with the invention can provide an illuminated volume of space above and about a lit task surface that allows for the creation of discrete, comfortably lit work spaces in low ambient lighting environments using a minimum number of fixtures.

The luminaire of the invention has a body which includes a base end and an extension portion that extends from a base end to a distal end. Means, such as a support stand or bracket, support the body relative to a task surface so that the extension portion of the body extends above the task surface, and such that the task surface is situated in front of the base end of the body portion. Task light means on the luminaire body produces light in a directional light distribution pattern that illuminates a task surface in front of the base end of the luminaire when the body is supported so that the extension portion of the body extends above the task surface. One or more light sources, such as one or more OLED panels or LEDs behind one or more diffuse plates, are provided on the extension portion of the body. The area light source or sources have a light emitting surface generally facing a space above the task surface when the body of the luminaire is supported so that its extension portion extends above the task surface. The area light source or sources emit light in a generally diffuse light distribution pattern such that the area light source or sources can illuminate the volume of space above and about the task surface. The size and light output of the area light source or sources are particularly selected to illuminate a limited human occupiable space proximate the task surface.

As used herein "generally diffuse" shall be understood to mean that the light is spread laterally from the area light source or sources to provide vertical illumination on features, such as facial features, within a volume of space about the task surface, which can be occupied by humans, and preferably also immediately above the task surface. Preferably, the ratio of the total available illumination at the task surface to vertical illumination available at a vertical plane within the volume of space above and about the task surface, and at least within the human occupiable regions about the task surface, is preferably no more than about 3:1. Also the vector/scalar ratio within such volume of space will be no greater than 3.0 and, depending on personal preferences, preferably between about 1.0 and about 2.0. Providing for vector/scalar ratio within the preferred range avoids overly harsh highlights and shadows on the one hand and undesirable flat, shadow-free light on the other.

It is noted that a generally diffuse light distribution pattern produced by the luminaire's area light source or sources can encompass a non-Lambertian distribution such as a bat wing distribution as well as light distribution patterns having the characteristics of a Lambertian distribution.

In a separate aspect of the invention, the area light source or sources will preferably provide a light emitting surface or series of light emitting surfaces that extend in a substantially linear fashion over the task surface such that light will be emitted in a generally diffuse light distribution pattern to either side and in front of the linear array. However, the luminaire of the invention is not limited to a linear array of area light sources for producing a generally diffuse light distribution pattern. The area light sources could instead be provided in non-linear patterns such as a staggered or square array. Additionally, the area light sources could be provided with or without optical elements for creating desired directionality within the generally diffuse light distribution pattern.

The invention is further directed to a method of creating effective proximity lighting about a task surface in a low ambient lighting environment, wherein there exists a volume of space above and about the task surface (the surround volume) including a limited human occupiable space within the surround volume. The method comprises the steps of directing task light in a directional light distribution pattern toward the task surface for illuminating the task surface, and producing light in a generally diffuse light distribution pattern from a localized source which illuminates the surround volume. Both the task light and the generally diffuse light are produced from a position or positions in proximity to the task surface.

DESCRIPTION OF ILLUSTRATED EMBODIMENT

Figure 1:
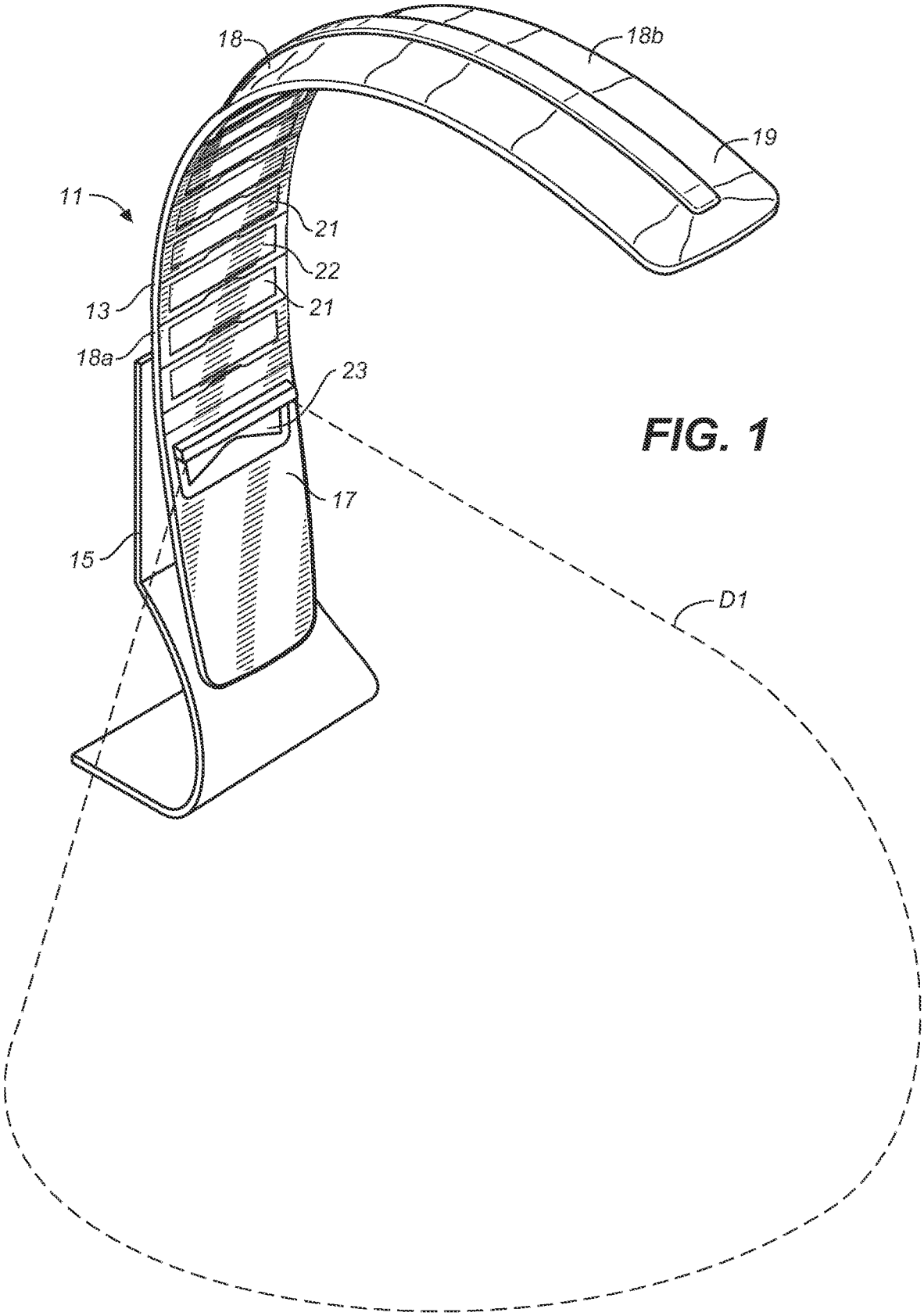
FIG. 1 is a top perspective view of a luminaire in accordance with the invention.
Figure 2:
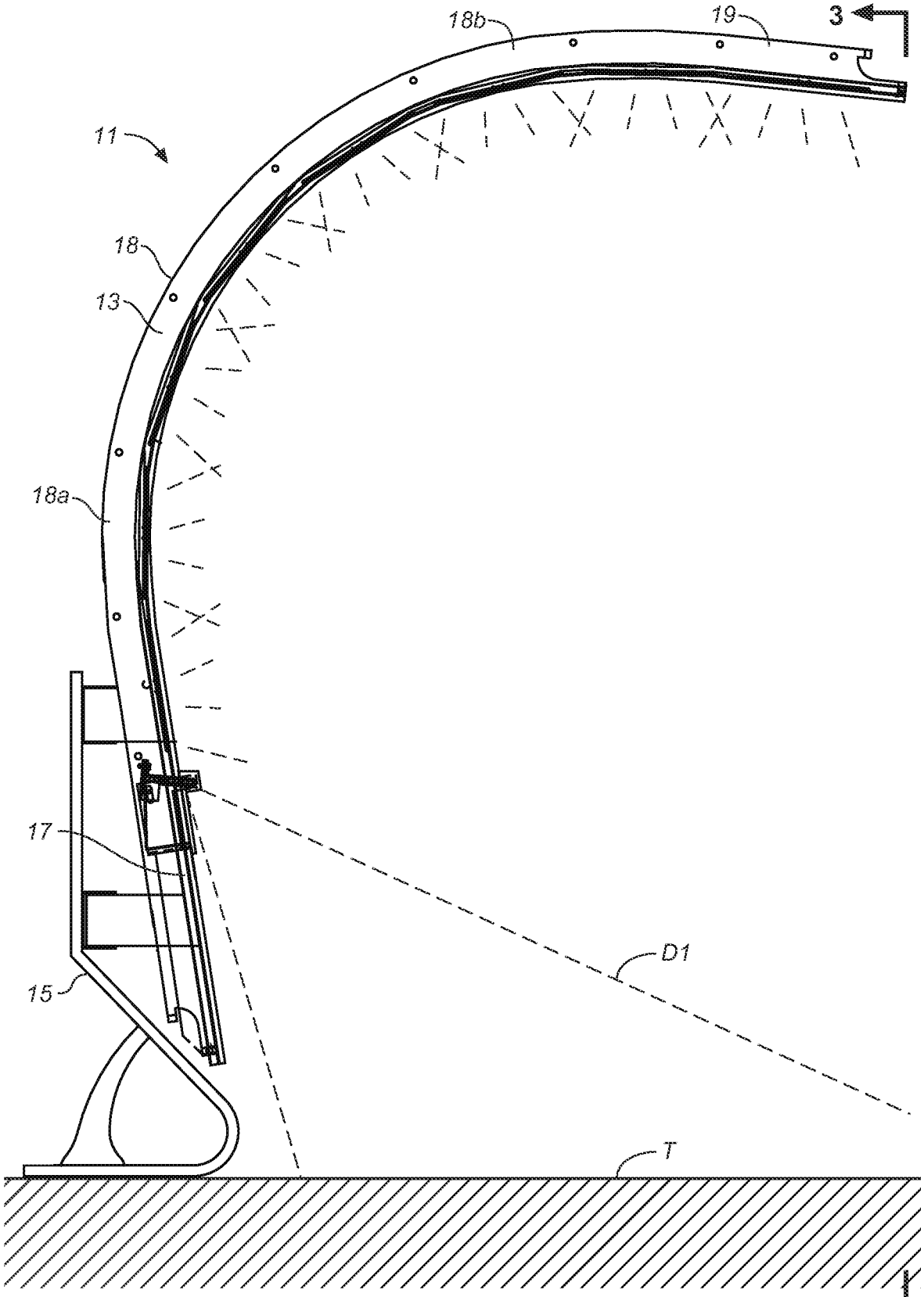
FIG. 2 is a side elevational view thereof, showing the luminaire set on top of a task surface.
Figure 3:
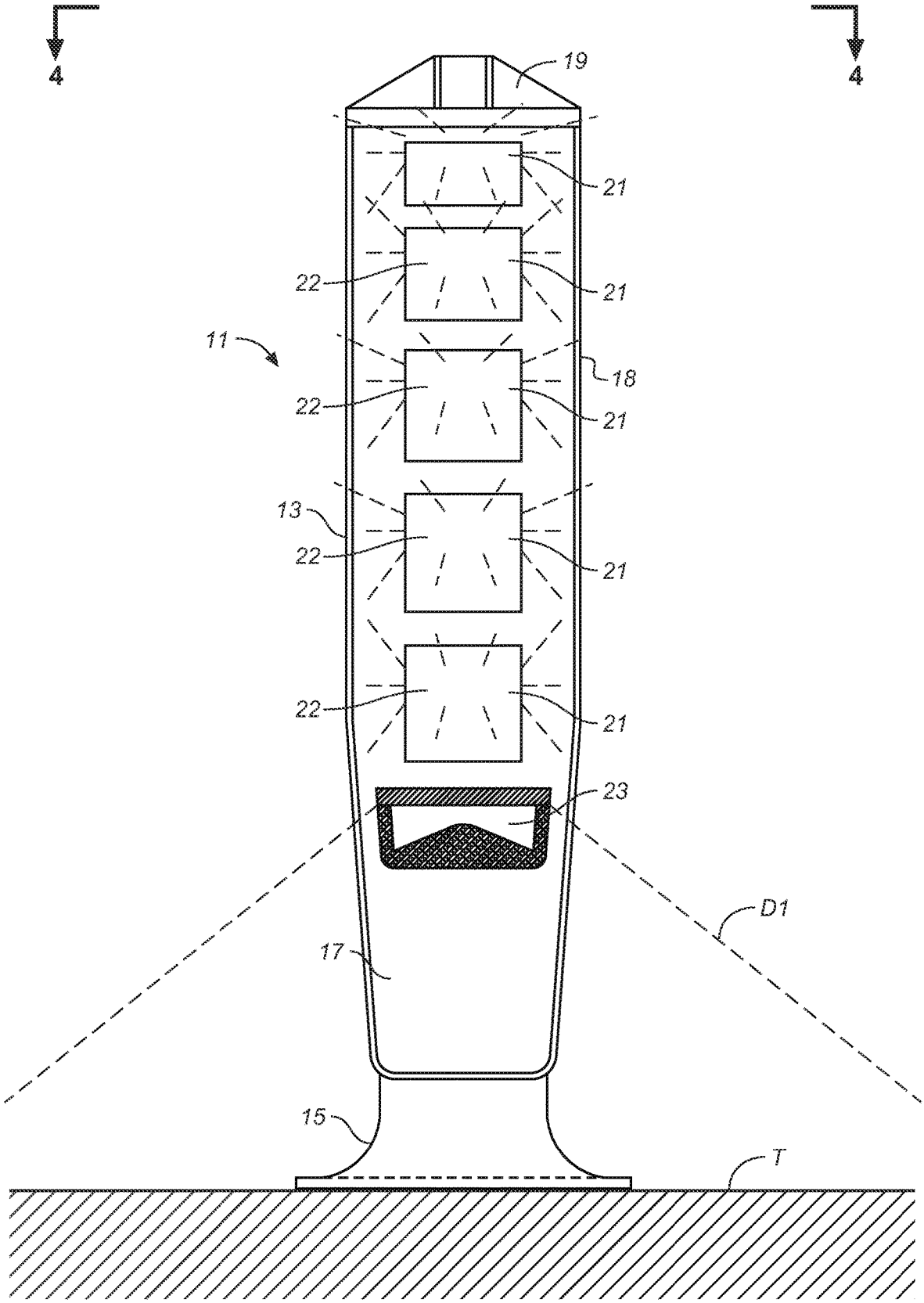
FIG. 3 is a front elevational view thereof.

The drawings show an illustrative embodiment of a luminaire in accordance with the invention, wherein the luminaire illuminates a task surface in front of the luminaire while at the same time injecting light into a volume of space above and about the task surface (the surround volume), which includes a limited occupiable space proximate the task surface. The luminaire of the invention creates what can be described as a personal "cocoon" of light for a person working in the task area to provide effectively lit work spaces in low ambient lighting environments.

The illustrated luminaire 11 is seen to have an elongated body 13 and means, such as a desk-top stand 15, for supporting the body relative to a task surface. (The task surface is shown in FIGS. 2-5 and denoted by the letter "T.") The luminaire body has a base end 17, which is attached by any suitable fastening mechanism to the desk-top stand 15 for holding the body in its desired upright orientation or operative position relative to the task surface. The luminaire body must extend above task surface T and the task surface must be situated in front of the base end of the luminaire body. It will be appreciated that the luminaire body could be held in its desired operative position by means other than the illustrated stand 15, such as by a floor stand next to the task surface or by an edge clamp or bracket for clamping or otherwise securing the luminaire body to the edge of a desk top or table top providing a task surface. Alternatively, the luminaire body might be supported from a wall or other structure adjacent the task surface or even possibly suspended in its operative position.

The body of the luminaire contains all of the lighting elements needed to effectively illuminate the task surface T and to create an illuminated volume of space above and about the task surface. In the illustrated embodiment, the body is seen to extend upwardly from its base end 17 to form an extension portion 18 having a distal end 19. The extension portion 18 has a generally vertical portion 18*a* and horizontal portion 18*b*, both of which face the volume of space above the task surface T. Preferably, the body extension has a linear form, and most suitably it will have a curvilinear form as shown that wraps over the space above the task surface. The elevation of the horizontal portion of the body is suitably in the range of about two feet to about four feet above the task surface for achieving the best manageable localized lighting environment.

Two functionally different light sources are provided on the luminaire body to achieve the desired localized lighting environment. The first is a task lighting means for providing light in a directional light distribution pattern directed onto the task surface. The second is at least one, and preferably a plurality of area light sources on the body's extension portion 18 that provide light in a generally diffuse light distribution pattern for illuminating the surround volume associated with the task surface. To adequately illuminate the human occupiable space proximate the task surface, the area light source or combination of light sources will preferably have a total surface area of between about 50 square inches and about 150 square inches and a luminance of generally between about 1000 cd/m$^2$ and about 3000 cd/m$^2$. By providing area light sources having a luminance within these ranges, a suitable amount of light is produced for illuminating the localized volume of space above and about the task surface without excessive surface brightness that can cause visual discomfort.

In the illustrated embodiment, the task lighting means is provided in the form of a task light 23 positioned at the base end 17 of luminaire body 13 such that it faces the space above the task surface. Task light 23 can suitably be constructed using LED light sources and optical components (reflectors and/or lenses) in a well-known manner to produce a directional light distribution pattern directed onto task surface T, such as represented by the distribution pattern denoted by the dashed lines D1 in FIGS. 2 and 3. While the task light is optimally positioned at the base end of the luminaire body as shown and described, it is contemplated that the task light could be positioned elsewhere on the luminaire body so long as the optics of the task light direct the task light onto the task surface. It is also contemplated that more than one task light could be provided, each of which produces a directional light distribution pattern directed toward the task surface, and that the task light or lights could be integrated into the area light source or sources in a manner discussed below.

In the illustrated embodiment, the source of generally diffuse light is provided by a plurality of area light sources 21 on the extension portion of the luminaire body. These area lights sources are suitably OLED panels and are distributed, and preferably evenly distributed, over the extension portion 18 of the luminaire's body 13 between the body's base end 17 and the distal end 19 of the extension. The area light sources each have a tight emitting surface 22 which generally faces the volume of space over the task surface, and which produces light in a generally diffuse distribution pattern. Area light sources other than OLED panels could be used. For example, LEDs could be positioned behind a diffuse plane where the diffuse plane acts as an area light source. Also, by providing a diffuser plate with an optical component, for example, lens and reflector elements at the center of the diffuser plate, a directional beam can be produced for illuminating the task surface. In other words, the area light source or sources would also provide directional task lighting.

Collectively, the area light sources produce generally diffuse light within a volume of space above and about the task area. This surround volume is depicted by the dashed line representation of the distribution pattern D2 in FIGS. 4 and 5. It will be appreciated that the diffuse distribution pattern D2, as well as the directional task light distribution pattern D1 shown in FIGS. 1-5, are conceptual only to illustrate the relative light contributions from these two functionally different types of light sources. Light levels will attenuate non-abruptly with distance from the source, and actual light levels at any point on the task surface and within the surround volume associated with the task area will be the result of contributions from the light from the task light and area light sources, as well as from any ambient lighting in the larger space, such as from overhead lighting.

The luminaire of the invention will achieve its particular utility when the general ambient lighting is low, and thus where its contribution to the light within the space immediately about the task area and luminaire is relatively insignificant. Generally, the sufficiency of the light within the surround volume will be determined by two factors: the amount of vertical illumination within the surround volume and particularly at the edge regions of the surround volume which define a human occupiable space (for example, the region of space occupied by the heads P1 and P2 shown in FIG. 4), and the vector/scalar ratio, which is a measure of the diffuseness of the light within the surround volume. A vector/scalar ratio that is too high will create excessive shadowing and/or highlighting much as occurs when a task light is used alone in a low ambient lighting environment. A ratio that is too low, that is where the light is too highly diffuse, produces undesirable flat, shadow free lighting.

Figure 4:
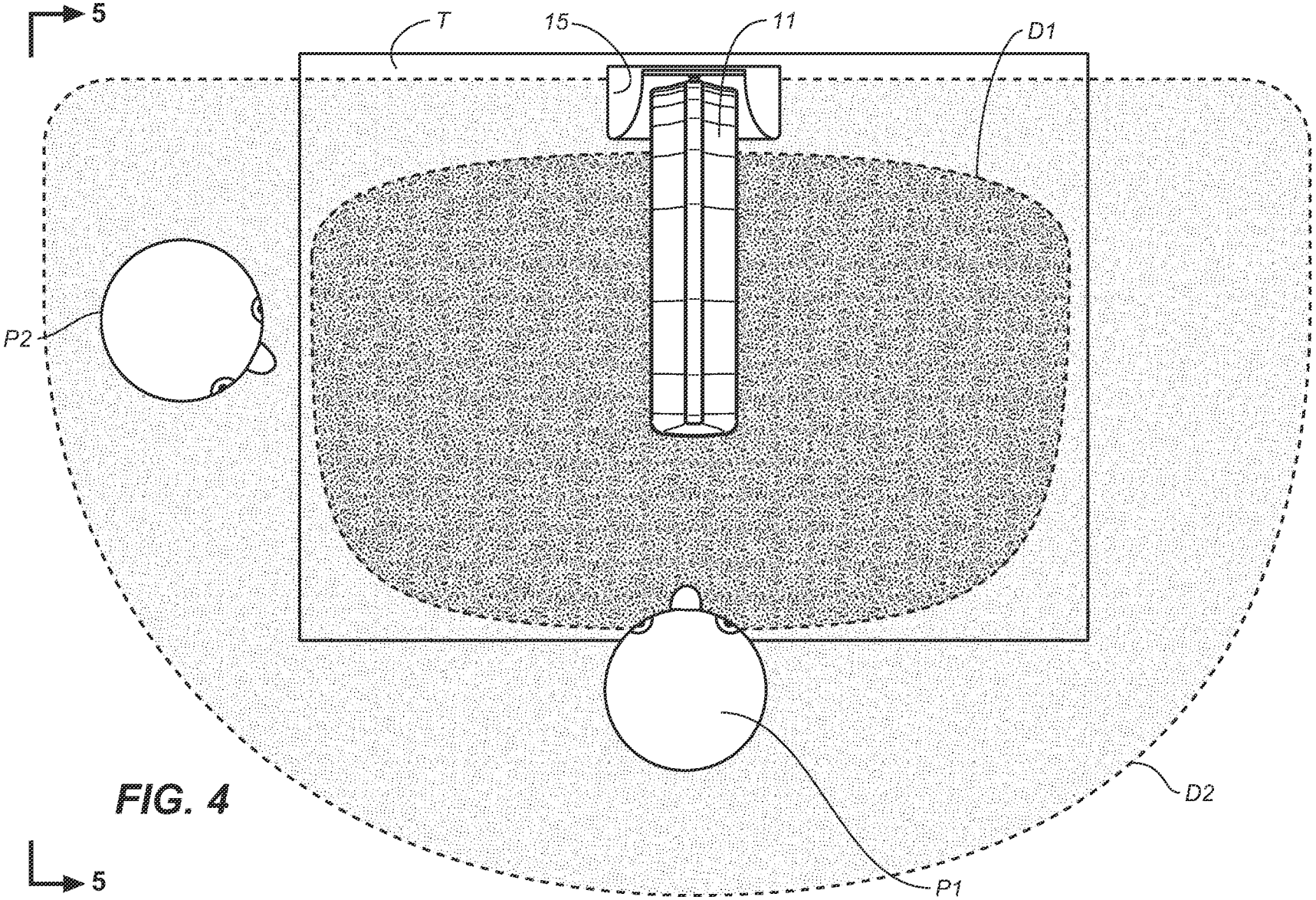
FIG. 4 is a top plan view of the luminaire illustrated in FIGS. 1-3 on a desk-top surface and showing representative coverage patterns for the task light component and proximity lighting component of the luminaire, and further showing people in the local work space.

Of the total available illumination produced within the surround volume, a significant amount should produce vertical illumination within the surround volume, or at least within the outer region or regions of the surround volume occupied by persons, such as person P1, P2 illustrated in FIG. 4, within the surround volume. Preferably, the ratio of total illumination at the task surface to vertical illumination will be no more than about 3:1 within at least the outer, human occupiable regions of the surround volume, and preferably throughout the surround volume. As to the vector/scalar ratio, this ratio should be no more than about 3.0 within the surround volume and preferably will be in a range of about 1.0 to about 2.0, depending on personal preferences.

It will be understood that the task lighting and the illumination within the surround volume produced by luminaire 11 will each be augmented by the other two sources of light. For example, the task light product by task light 23 in the illustrated luminaire would be augmented by the light produced by the area light sources 23 ("surround light") and the low ambient light in the space. An example of the relative contributions of these different sources to the task lighting might be as follows:

| |
|---|
| Ambient light - 10 footcandles |
| Surround light - 10 footcandles |
| Task light - 20 footcandles |

Also, it is noted that the relative contributions of light from these three sources will affect the vector/scalar ratio for the light within the surround volume as well as the vector/scalar ratio.

Instead of using a plurality of distributed area light sources as shown in the illustrated embodiment, the diffuse lighting component of luminaire 11 could be provided by one or a few elongated area light sources, such as elongated OLED panels, that cover a substantial portion of the body extension portion 18. Preferably, most of the area of the extension portion will be covered by the area light sources, including the generally vertical portion 18*a* and generally horizontal portion 18*b*. However, a luminaire in accordance with the invention may have its area. light source or sources on a horizontal portion only or a vertical portion only or partially on both portions, so long as sufficient generally diffuse light is produced to meet the localized proximity lighting criteria discussed above. Indeed, the extension portion of the luminaire could be substantially vertical only or substantially horizontal only.

As indicated above, the total surface area of the light emitting surfaces of the area light sources (surfaces 22 of OLED panels 21 in the illustrated embodiment) will preferably be between about 50 square inches and about 150 square inches. This surface area will preferably have a luminance of between about 1000 cd/m$^2$ and about 3000 cd/m$^2$ in order to generate an adequate lighting level within the surround volume without excessive brightness.

Figure 5:
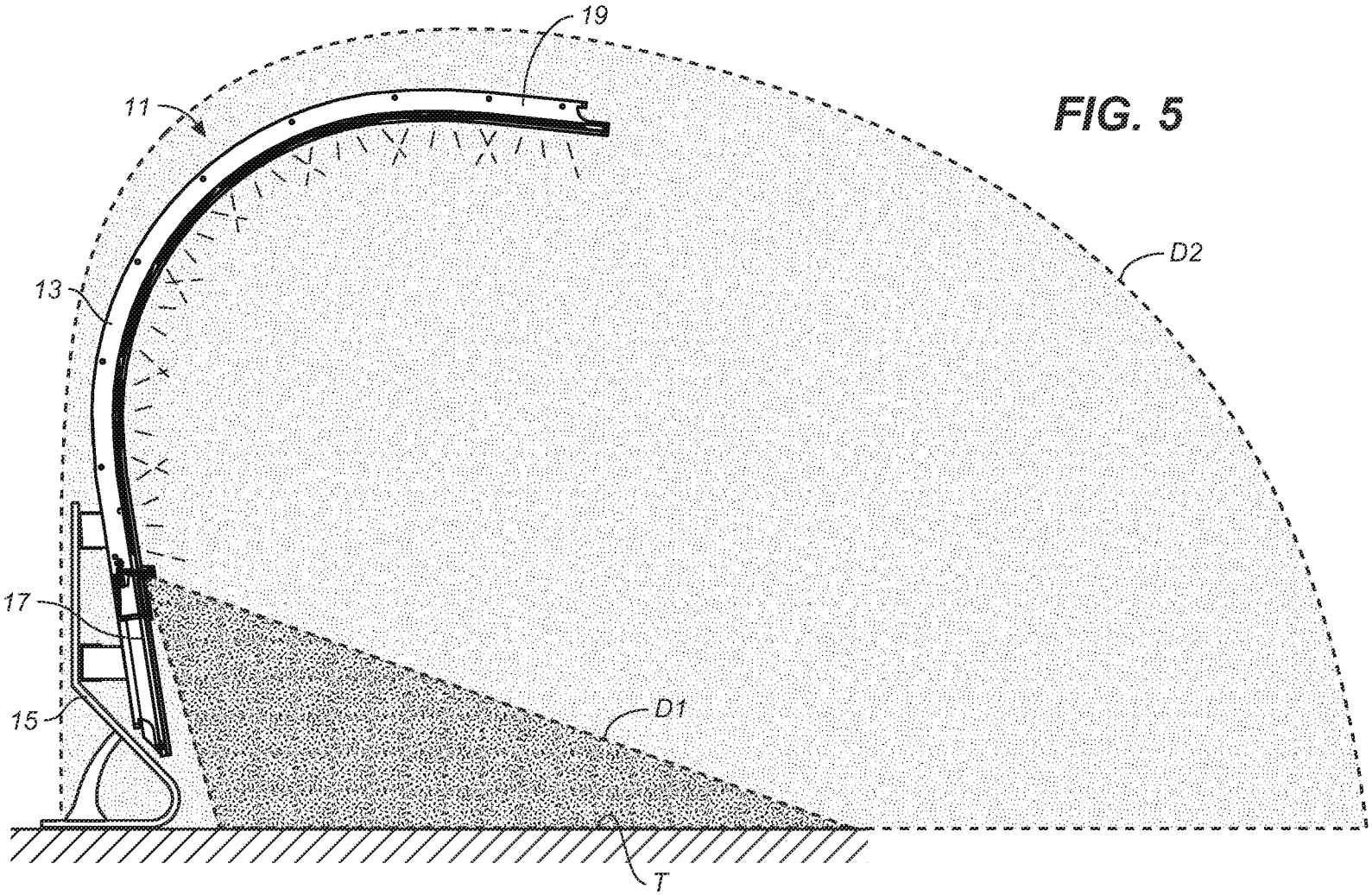
FIG. 5 is a side elevational view thereof (without the people) showing representative coverage patterns in the vertical plane.

The beneficial properties of the generally diffuse light produced in the surround volume by luminaire 11 can be described in reference to FIG. 5, which shows two people denoted P1 and P2 in the vicinity of a task area defined by desk-top T. One person, P1, is shown in front of and presumably working a the desk-top T, which is illuminated by the task light 23 of luminaire 11 as represented by the light distribution pattern D1. A colleague, P2, is shown sitting next to P1 to the side of the desk-top. Both P1 and P2 are seen to be within the surround volume and thus within the zone of illumination produced by the area light sources 21 distributed over the extension portion 18 of the luminaire body 13. Due to the generally diffuse light produced within the surround volume by the luminaire's area light sources (represented by distribution pattern D2), and particularly the vertical illumination produced by such area light sources, the faces of both individuals will be illuminated, thus avoiding excessive facial highlights and/or shadows that would occur if a task light only were used in a low ambient lighting environment. Such highlights and/or shadows would detract from the ability of P1 and P2 to easily communicate. (On the other hand, excessively flat lighting can be avoided as above-described by designing or selecting area light sources that produce light within a range of vector/scalar ratios). The energy required to produce such lighting bubbles throughout a work place will be substantially less than the energy required to illuminate the entire work space with high levels of ambient lighting.

It is contemplated that either or both the task light 23 and area light sources 21 can be dimmable to permit the amount and relative contribution of these two light sources to be controlled by persons at the task area. Both of these functionally different lighting components can be dimmed separately or together to provide maximum individual personalization of light levels at each workstation. Also, while the area light sources have been described as having a generally diffuse light distribution pattern, it is contemplated that light distribution pattern of individual area light sources may have some degree of directionality, so long as the plurality of sources collectively provides illumination throughout the surround volume which meets the criteria discussed above.

While an embodiment of the present invention has been described in considerable detail in the foregoing specification and accompanying drawings, it will be understood that it is not intended that the invention be limited to such detail, except as necessitated by the following claims.

I claim:

1. A luminaire for illuminating a task surface and a volume of space above and about the task surface, including a limited human occupiable space proximate the task surface, said luminaire comprising:

a body having a base end and an extension portion extending from said base end, said extension portion having a distal end remote from said base end, means for supporting said body in an operative position relative to a task surface such that the task surface is situated in front of the base end of the body and the extension portion of said body extends above the task surface, task lighting means on said body, said task lighting means being configured to direct light in a directional light distribution pattern toward a task surface when the body is supported in its operative position relative to the task surface, and at least one area light source on the extension portion of said body, said area light source having a light emitting surface of between about 50 square inches and about 150 square inches that faces a space generally above the task surface when the body is supported in its operative position relative to the task surface without any portion of the luminaire being disposed in the space between said area light source and the task surface, said area light source being configured such that light emitted from the light source's light emitting surface is emitted in a generally diffuse light distribution pattern for illuminating the space above and about the task surface, and such that the luminance of the light emitting surface of the area light source is between about 1000 cd/m$^2$ and about 3000 cd/m$^2$ when light is emitted therefrom.

2. The luminaire of claim 1 wherein said task light means is comprised of a task light source positioned at the base end of said body and optical means for directing light emitted by said light source in a forward and downward direction onto a task surface in front of the base end of the body.

3. The luminaire of claim 1 wherein a plurality of area light sources is provided on the extension portion of said body, wherein each of said area light sources has a light emitting surface having a surface area generally facing without obstruction a space above the task surface when said body is supported in its operative position relative to the task surface, and wherein the total surface area of the light emitting surfaces of said plurality of area light sources that face the space above the task surface is between about 50 square inches and about 150 square inches.

4. The luminaire of claim 3 wherein said plurality of area light sources is distributed along the length of the extension portion of said body.

5. The luminaire of claim 1 wherein the extension portion of said body has a substantially vertical portion and a substantially horizontal portion, and wherein both the vertical and horizontal portions face the space above the task surface when said body is supported in its operative position relative to the task surface, and wherein said at least one light source emits light from both the vertical and horizontal portions of said extension portion.

6. The luminaire of claim 1 wherein, when said body is supported in its operative position relative to the task surface, the extension portion is positioned no more than about four feet above the task surface.

7. The luminaire of claim 1 wherein said at least one area light source produces generally diffuse light wherein the ratio of the total illumination of light at the task surface to the vertical illumination within the limited human occupiable space proximate the task surface is no more than about three to one.

8. The luminaire of claim 1 wherein the extension portion of the body has a substantially linear form, wherein said at least one area light source provides one or more light emitting surfaces that extend along the linear form of the body extension portion, and wherein the generally diffuse light distribution pattern of said area light source spreads light away from the linear form into the limited human occupiable space proximate the task surface.

9. The luminaire of claim 8 wherein said area light source is a planar OLED light source.

10. The luminaire of claim 8 wherein the substantially linear form of the extension portion of said body wraps over the space above the task surface.

11. The luminaire of claim 10 wherein the substantially linear form of the extension portion of said body is a curvilinear form that wraps over the space above the task surface.

12. A luminaire for illuminating a task surface and a volume of space above and about the task surface, including a limited human occupiable space proximate the task surface, said luminaire comprising:

a body structure having a base end and extending upwardly from said base end to form an extension portion having a distal end, means for supporting said body in an operative position relative to a task surface wherein the task surface is situated in front of the base end of the body and the extension portion of said body extends above the task surface, task light means on said body for providing light in a directional light distribution pattern, wherein, when said body is supported in its operative position relative to the task surface, the light provided by said task light means is directed toward the task surface, and a plurality of area light sources distributed along the extension portion of said body from the base end to the distal end of said extension portion, each of said area light sources having a light emitting surface generally facing a space above the task surface when said body is supported in its operative position relative to the task surface without any portion of the luminaire being disposed in the space between said area light sources and the task surface, the light emitting surfaces of said area light sources collectively having a total surface area of between about 50 square inches and about 150 square inches and being configured such that light emitted therefrom is emitted in a generally diffuse light distribution pattern, and such that the luminance of the light emitting surfaces of said area light sources is between about 1000 cd/m$^2$ and about 3000 cd/m$^2$ when light is emitted therefrom.

13. The luminaire of claim 12 wherein the extension portion of said body structure has a substantially vertical portion and a substantially horizontal portion, wherein both the vertical and horizontal portions of said extension portion face the space above the task surface when said body is supported in its operative position relative to the task surface, and wherein said area light sources are distributed along both the substantially vertical and horizontal portions of said extension portion.

14. The luminaire of claim 12 wherein the extension portion of the body has a substantially curvilinear form that wraps over the space above the task surface, wherein the area light sources are arranged substantially in a line along the curvilinear form of the body extension portion, and wherein the generally diffuse light distribution pattern of said area light sources spreads light away from the curvilinear form of the body extension portion into the limited human occupiable space proximate the task surface.

15. The luminaire of claim 12 wherein said task light means is comprised of a task light source positioned at the base end of said body and optical means for directing light emitted by said light source in a forward and downward direction onto a task surface in front of the base end of the body, and wherein said plurality of area light sources is distributed along the extension portion of said body generally from a position above said task light source to the distal end of said extension portion.

16. A luminaire for illuminating a task surface and a volume of space above and about the task surface, including a limited human occupiable space proximate the task surface, said luminaire comprising:

a body structure having a base end and extending upwardly from said base end to form an elongated extension portion having a substantially vertical portion, a substantially horizontal portion and a distal end, means for supporting said body in an operative position relative to a task surface wherein the task surface is situated in front of the base end of the body and the extension portion of said body extends above the task surface so that the substantially vertical and substantially horizontal portions of said extension portion face the space above the task surface, a task light means at the base end of said body, said task light means being configured to direct light in a directional light distribution pattern in a forward and downward direction onto a task surface in front of the base end of the body, and a plurality of area light sources distributed along the substantially vertical and substantially horizontal portions of said extension portion from above the task light means at the base end of said body to the distal end of said extension portion, each of said area light sources having a light emitting surface generally facing a space above the task surface when said body is supported in its operative position relative to the task surface without any portion of the luminaire being disposed in the space between said area light sources and the task surface, said area light sources being configured to emit light in a generally diffuse light distribution pattern wherein, when said body is supported in its operative position relative to the task surface, the light emitting surfaces of said area light sources can illuminate the space above and about the task surface, and the area light sources further being configured such that the luminance of said light emitting surfaces is between about 1000 cd/m$^2$ and about 3000 cd/m$^2$ when light is emitted therefrom.

17. The luminaire of claim 16 wherein the extension portion of the body has a substantially curvilinear form that wraps over the space above the task surface, wherein the area light sources are arranged substantially in a line along the curvilinear form of the body extension portion, and wherein the generally diffuse light distribution pattern of said area light sources spreads light away from the curvilinear form of the body extension portion into the limited human occupiable space proximate the task surface.

* * * * *